US010636645B2

(12) United States Patent
Gamble et al.

(10) Patent No.: US 10,636,645 B2
(45) Date of Patent: Apr. 28, 2020

(54) DUAL CHAMBER ELECTRON IMPACT AND CHEMICAL IONIZATION SOURCE

(71) Applicant: PERKINELMER HEALTH SCIENCES CANADA INC., Woodbridge (CA)

(72) Inventors: Heather Gamble, Richmond Hill (CA); Gholamreza Javahery, Kettleby (CA); Lisa Cousins, Woodbridge (CA); Charles Jolliffe, Schomberg (CA); Miles Snow, Newmarket, CA (US)

(73) Assignee: PerkinElmer Health Sciences Canada, Inc., Woodbridge (CA)

( * ) Notice: Subject to any disclaimer, the term of this patent is extended or adjusted under 35 U.S.C. 154(b) by 0 days.

(21) Appl. No.: 15/958,781

(22) Filed: Apr. 20, 2018

(65) Prior Publication Data

US 2019/0326109 A1 Oct. 24, 2019

(51) Int. Cl.
*H01J 49/14* (2006.01)

(52) U.S. Cl.
CPC ..... *H01J 49/147* (2013.01); *H01J 49/145* (2013.01)

(58) Field of Classification Search
CPC ..... H01J 49/08; H01J 49/10; H01J 49/145; H01J 49/147; H01J 27/02; H01J 27/16; H01J 27/18
See application file for complete search history.

(56) References Cited

U.S. PATENT DOCUMENTS 3,553,452 A * 1/1971 Tiernan ..... H01J 49/24 250/287
4,005,291 A * 1/1977 Arsenault ..... H01J 49/10 250/282
4,862,032 A 8/1989 Kaufman
4,963,736 A 10/1990 Douglas
6,661,178 B1 * 12/2003 Bertrand ..... H01J 27/04 250/426
7,642,510 B2 * 1/2010 McEwen ..... H01J 49/0422 250/288
7,868,289 B2 1/2011 Cousins et al.
8,501,624 B2 * 8/2013 Koo ..... H01J 37/08 438/689
2008/0116369 A1 * 5/2008 McCauley ..... H01J 49/145 250/288
2009/0194679 A1 * 8/2009 Doherty ..... H01J 49/0045 250/282
2011/0266433 A1 * 11/2011 Jarrell ..... G01N 30/7206 250/282

(Continued)

FOREIGN PATENT DOCUMENTS

WO WO-2007102204 A1 * 9/2007 ..... G01N 27/62

OTHER PUBLICATIONS

ISR/WO for PCT/IB2019053154 dated Aug. 19, 2019.

*Primary Examiner* — David E Smith
(74) *Attorney, Agent, or Firm* — Rhodes IP PLC; Christopher R Rhodes

(57) ABSTRACT

A mass analyzer includes two chambers for ionizing gas to form ions and/or introducing reaction gases to aid in ionization. A first chamber includes an electron to allow electron bombardment of a first gas. A second chamber receives a second gas and ions from the first chamber to allow interaction between the second gas, and the ions from the first chamber. The first and/or second gas may include analyte.

20 Claims, 3 Drawing Sheets

(56) References Cited

U.S. PATENT DOCUMENTS

| | | | | |
|---|---|---|---|---|
| 2012/0149125 | A1* | 6/2012 | Earley | H01J 49/0072<br>436/173 |
| 2013/0214147 | A1* | 8/2013 | Mullen | H01J 49/147<br>250/282 |
| 2014/0145073 | A1* | 5/2014 | Johnson | G01N 21/31<br>250/282 |
| 2017/0352528 | A1* | 12/2017 | Schwieters | H01J 49/0422 |

* cited by examiner

DUAL CHAMBER ELECTRON IMPACT AND CHEMICAL IONIZATION SOURCE

TECHNICAL FIELD

This relates to mass analysis, and more particularly to an ion source that relies on electron impact ionization and/or chemical ionization.

BACKGROUND

Conventional mass spectrometry techniques rely on the formation of analyte ions for analysis. Numerous ionization techniques—such as electrospray ionization, chemical ionization, and electron impact ionization techniques are known.

Existing techniques, however, often lack flexibility.

Accordingly, there remains a need for new ionization techniques, apparatus and mass analyzers relying on such techniques.

SUMMARY

According to an aspect, there is provided an ion source for a mass analyzer, that includes first and second chambers (or cells). The first chamber includes an electron source that allows electron bombardment of a first gas introduced into the first chamber. The second chamber receives a second gas and ions from the first chamber to allow interaction between the second gas, and the ions from the first chamber. Analyte may be introduced by way of the first or second gas.

According to another aspect, there is provided a mass analyzer comprising a chamber having a first gas inlet for receiving gas, and an ion outlet opposite the gas inlet; an electron source; said chamber further having electron inlet, and an electron collector opposite the electron inlet, and arranged to direct an electron beam from the electron source through the electron inlet, along a path transverse to a path between the first gas inlet and the ion outlet; and a reaction cell comprising a second gas inlet to receive a second gas, the reaction cell located downstream of the chamber for receiving ions from the ion outlet, and allowing the second gas to interact therewith.

Other features will become apparent from the drawings in conjunction with the following description.

BRIEF DESCRIPTION OF THE DRAWINGS

In the figures which illustrate example embodiments.

DETAILED DESCRIPTION

Figure 1:
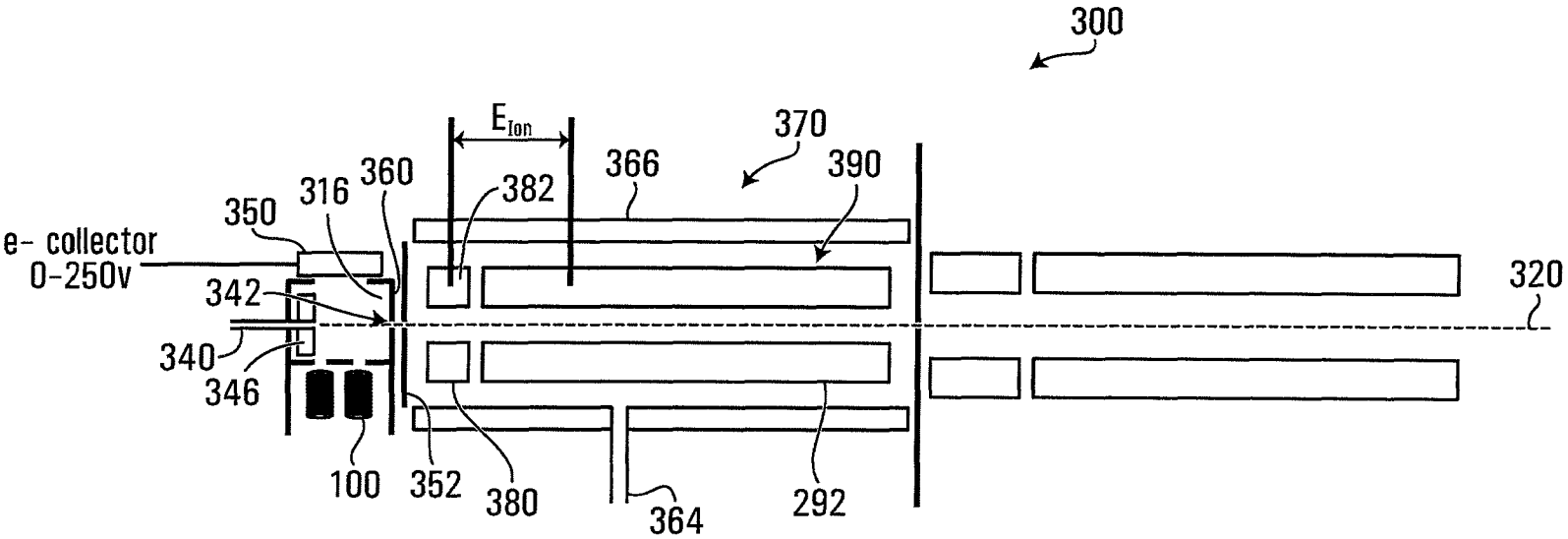
FIG. 1 is a schematic block diagram of a two chamber ionization source, forming part of a mass analyser, exemplary of an embodiment.
Figure 3:
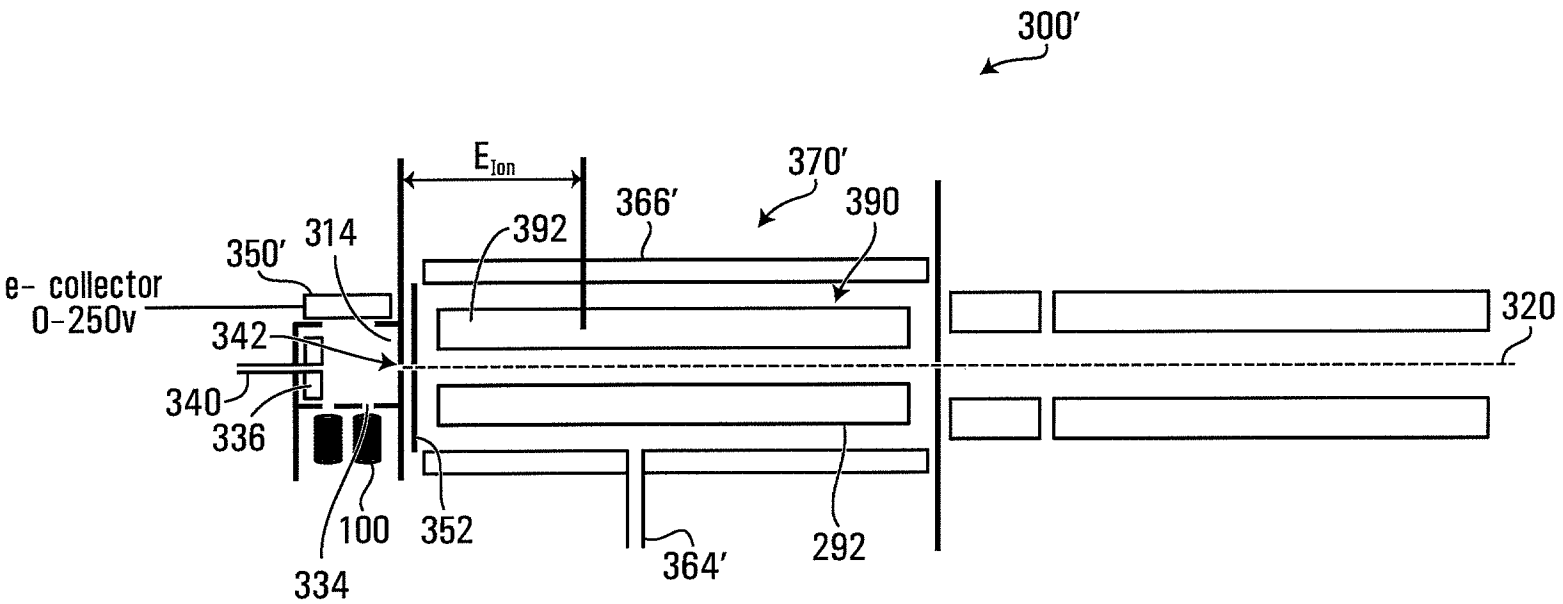
FIG. 3 is a schematic block diagram of an alternate electron impact ionization source and downstream reaction cell, forming part of a mass analyser.

FIGS. 1 and 3 illustrate that example mass analyzers 300, 300' incorporating two chamber/cell ionization source. Analyzer 300 may produce ionized analyte by way of either electron impact ionization; chemical ionization or both.

To that end, example mass analyser 300 includes an ionization cell including a chemical ionization chamber 316 in a housing. Housing may be generally rectangular (with square or rectangular faces) or cylindrical in shape, formed of a generally conductive material, such as a metal or alloy. Example dimensions of housing may be between about 10 mm and 200 mm. In an embodiment, dimensions of housing may be 24.5 mm×12 mm×25.4 mm. In alternate embodiments, housing may have other shapes—preferably symmetrical about a plane—and may be right cylindrical (with circular, elliptical, rectangular or other shaped base), spherical or the like. Chamber 316 includes an analyte inlet 340, and an ionized sample outlet 342 in housing located on generally opposite sides of chamber 316. Sample outlet 342 is generally co-axial with a guide axis 320 of mass analyser 300.

Analyte inlet 340 may be supplied by a suitable source of analyte—preferable in gaseous form—and may thus be gas inlet. Analyte may, for example, be supplied from a gas chromatograph, ambient sampling, or any other source known to those of ordinary skill.

Analyte inlet 340 may further allow the introduction of an additional chemical ionization gas that may interact and react with introduced analyte to cause chemical ionization within chamber 316. The reaction gas may, for example, be introduced coaxially with the introduced analyte through analyte inlet 340. The second gas may chemically react with the analyte gas (thereby acting as a reaction gas), or simply physically bombard the analyte gas (thereby acting as a bombardment gas). Typically, chemical ionization is accompanied by minimal fragmentation of the analyte.

The second gas may, for example, be introduced co-axial with the introduced analyte. As will be appreciated, a suitable second gas could otherwise be introduced into chamber 316, for example, by way of a further gas inlet (not specifically illustrated) proximate analyte inlet 340 or elsewhere on the walls of chamber 316.

In chemical ionization within chamber 316, ions may be produced via collision of (neutral) analyte molecules with ions generated from an introduced reactant gas. Example chemical reactant gases include $CH_4$, $NH_3$, isobutane. Others will be apparent to those of ordinary skill. The reactant gas is typically introduced in far excess to the target analyte so that incoming electrons preferentially ionize the reactant gas. Once the reactant gas is ionized, a variety of chemical reactions with the target analyte may occur, such as protonation $[M+XH^+ \rightarrow M-H^+ + X]$, hydride abstraction $[MH+X^+ \rightarrow M^+ + XH]$, adduct formation $[M+X+ \rightarrow M-X^+]$, charge exchange $[M+X^+ \rightarrow M^+ + X]$. M, MH represents the analyte, while $XH^+$, $X^+$ are species derived from the reactant gas.

A bombarding gas could be a noble gas (He, Ne, Ar, Kr, Xe), an inert gas such as $N_2$, or a simple diatomic gas such as NO or CO. If a bombarding gas is used, the bombarding gas may be ionized, and then selectively be used to ionize analytes depending on the relative ionization energies: $X+e^- \rightarrow X^+$ (ionization of bombarding gas). $X^+ + M \rightarrow M^+ + X$ (if ionization energy of analyte M<ionization energy of bombarding gas X). Otherwise there is no reaction. Different bombarding gases have different inherent ionization energies.

Analyte and reaction gas travel from inlet 340, on one side of chamber 316 to the opposite side and is/are ionized along its path. A charged element 346 having a voltage applied thereto may accelerate ions within chamber 316, as they travel toward outlet 342.

Charged element 346 may take the form of a rectangular plate, or be formed as a hollow cylinder with, for example, having an outer diameter of 2.2 mm and a length of 4-8 mm, with cylinder axis oriented toward the sample outlet 342, and positioned such that the analyte travels through charged element 346 as ions exit outlet 342. The applied voltage could be in the range −400 to +400V.

Multiple electron inlets 334 (in this case four) may be located on a further, third side of chamber 316, and allow introduction of electrons as a beam along a path generally transverse to the path between analyte inlet 340 and sample outlet 342. Introduced electrons may bombard analyte and reaction gas within chamber 316 as they pass to outlet 342.

An example electron source, of the form of electron source and accelerator 100, may feed each of inlets 334. Electron inlets 334 may act as focusing lenses for electrons from accelerator 100 into chamber 316. To that end, electron inlets 334 may be formed in a conductive plate or portion thereof that may be electrically isolated from the remainder of chamber 316. Electron inlets 334 may be positioned to allow electrons generated by each to pass through. A suitable voltage—for example in the range 0 to +400 V—could be applied to the plate, or the plate could be grounded. An electron collector 350 is located opposite electron inlets 334 and may aid in accelerating and steering introduced electrons. A suitable voltage (e.g. 0-250 V) may be applied to electron collector 350.

Figure 2:
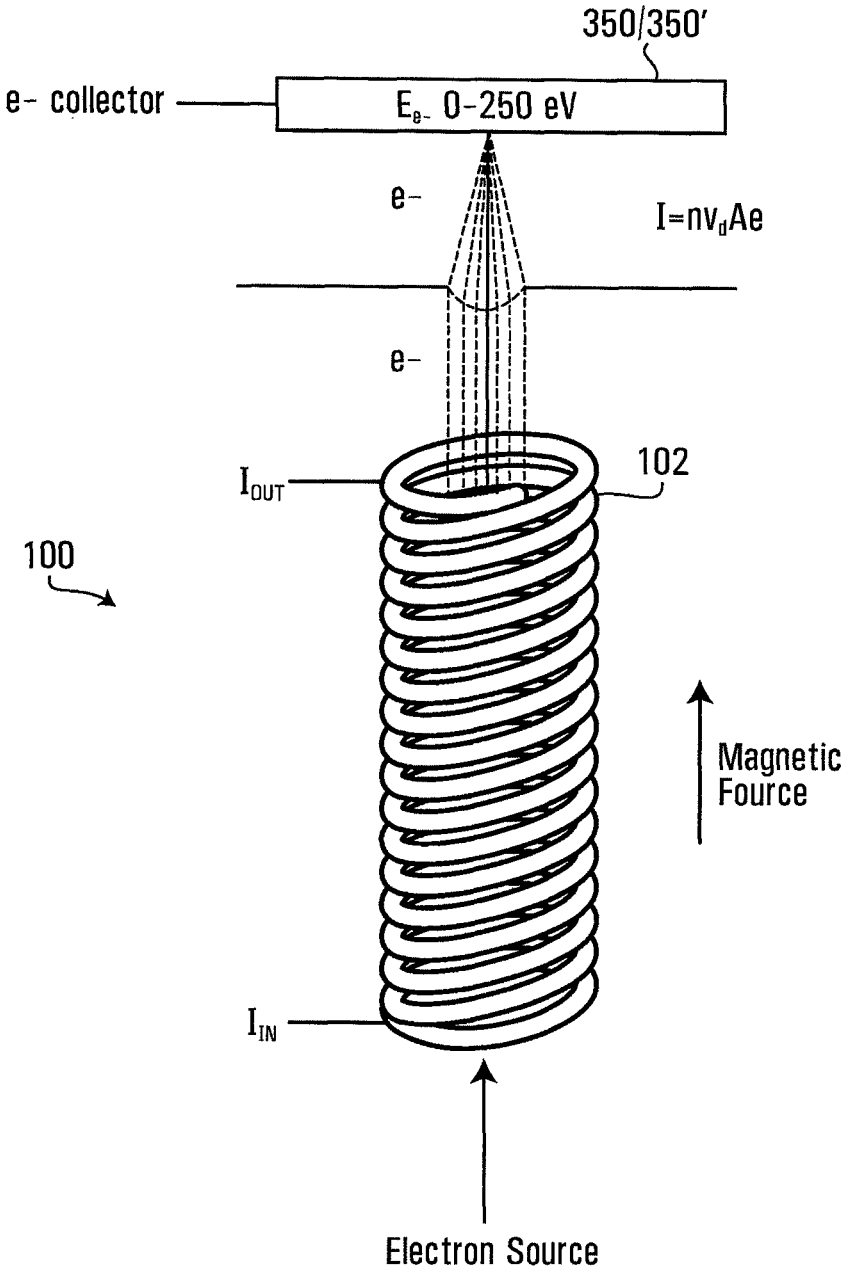
FIG. 2 is a schematic block diagram of an electron accelerator of the ionization source of FIG. 1.

An example electron accelerator 100 is illustrated in FIG. 2, and takes the form of conductive helical coils 102, wound around an axis generally parallel to the travel axis of electrons within chamber 316. Coils 102 may be wound to form a void of about millimeter size (e.g. 0.5 to 3 mm, preferably 1 mm), and at winding density of about 10 turns per cm. As will be appreciated, any applied electrical current to coil 102, in turn also generates a magnetic field generally along axis of the coil 102. A series resistance, or inherent resistance of coil 102, may limit the current flowing into coil 102. The magnitude of the magnetic field may be controlled by the applied current to coil 102, in manners appreciated by those of ordinary skill. Coil 102 may be formed of an electron emitting material—such as tungsten, or may be introduced from another source. Electrons are introduced along axis of the coil 102, and are focused as an electron beam, accelerated by the magnetic field, prior to introduction of the electrons into electron inlets 344 of chamber 316. Accelerated electrons may thus enter chamber 316, with an initial well defined velocity, to collide with analyte (and reaction gas) traversing from inlet 340 to outlet 342.

As will be appreciated, accelerators 100 may accelerate electrons by way of the Lorentz force—$F=qv\times B$ where F, v, and B represent the electron velocity vector, and the magnetic field vector, of the magnetic field generated by coils 102. Their vector cross product (scaled by the electron charge) determines the force on an electron. The resultant force F is perpendicular to both the velocity v of the particle with charge q, and the magnetic field vector B. As a consequence, the electron velocity is constrained to a direction along axis of the coil 102, or to circular motion centered around the axis of the coil 102 with F acting as a centripetal force. Coil 102 would be wound about a straight axis. However, other geometries, in which coil 102 is wound about a non-linear axis may be possible—coil 102 could, for example, be wound around an arc, curve or the like.

Outlet 342 of chamber 316 (FIG. 1) is formed in a wall of chamber 316, and defines focusing lens. A further focusing lens 352 may be placed around outlet 342. Ions exiting chamber 316 may exit on analyser axis 320.

A downstream reaction cell 370 receives ionized gas (e.g. analyte and optionally reaction gas) from chamber 316. A further gas may be introduced into reaction cell 370 by way of (second) gas inlet 364. Further, a heating element 366 may heat reaction cell 370 to provide additional thermal energy thereto. Reaction cell 370 may for example be heated to between 300 and 500° C.

Reaction cell 370 may take the form of a two stage reaction cell having a first stage 380 including a rod set 382 arranged in quadrupole about analyser axis 320, and a second stage 390 including a rod set 292 further arranged in quadrupole around axis 320, downstream of first stage 380, as for example described in U.S. Pat. No. 7,868,289, the contents of which are incorporated by reference herein. Suitable voltages may be applied to rod set 382 to create a generally sinusoidal containment field about axis 320, and to guide ions along axis 320. Rod set 382 may, for example, act as a collision cell as is known in the art, which could have a pre-filter to aid ion focusing into the cell and/or to adjust ion energy. An axial field may also be applied to rod set 382. A suitable rod set is for example detailed in U.S. Pat. No. 7,868,289.

A reaction potential $E_{ION}$ may be applied between the first and second stages of reaction cell 370 to select reaction energy. A low reaction potential favours molecular ion formation while high energy favours fragmentation.

Reaction gas within reaction cell 370 may interact with ionized analyte exiting chamber 316. This reaction may further selectively cause ionization of the ionized analyte exiting sample outlet 342.

Fragmented analyte may also exit outlet 342 and be further ionized in the downstream reaction cell 370, by way of the reaction gas introduced to reaction cell 370 at inlet 364.

In alternate embodiments, as for example mass analyzer 300' depicted in FIG. 3, chamber 316 may be replaced with an electron impact chamber 314, allowing electron impact to be used in place of chemical ionization of analyte.

A gas to be ionized may thus be introduced into chamber 314 without a reaction gas, by way of inlet 330. Electron bombardment may ionize and/or fragment this gas introduced by way of inlet 330.

Again, introduced gas travels from inlet 340 on one side of chamber 314 to the opposite side toward outlet 342 and is ionized along its path. A charged element 336, having a suitable voltage applied thereto, may accelerate ions within chamber 314, as they travel toward outlet 342.

Multiple electron inlets 334 (in this case, again, four) are on a further, third side of chamber 314, and allow the introduction of electrons along a path generally transverse to the path between inlet( )340 and outlet 342. Introduced electrons, may bombard gas as it passed from inlet 340 to outlet 342, and aid in, or cause, its ionization.

An example electron source, of the form of electron source and accelerator 100 is again depicted in FIG. 2, and may feed each of electron inlets 334. Electron inlets 334 may act as focusing lenses for introduced electrons. An electron collector 350' located opposite electron inlets 334 may aid in accelerating and steering electrons. A suitable voltage (e.g. 0-250 V) may be applied to electron collector 350'.

Analyte exiting outlet 342 may be focused by a focusing lens (formed in a wall of chamber 314) and a further downstream focusing lens 352.

A downstream reaction cell 370' receives ionized and/or fragmented gas from chamber 314. An interaction gas may be introduced into cell 370' by way of inlet 364'. Further, a heating element 366' may heat reaction cell 370'. Reaction cell 370' may take the form of a single stage reaction cell—that may for example be a collision cell—having a first stage 390' including a rod set 392' arranged in quadrupole about axis 320. The interaction gas in reaction cell 370' may interact with ionized gas exiting chamber 314. This reaction gas may further selectively cause interaction of the ionized gas exiting sample outlet 332 and the gas introduced.

Example reactions for Analyte A introduced into chamber 314 are described below. B/C are bombarding/reaction gases.

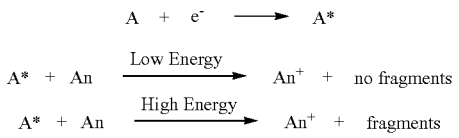

Ion-Molecule Rx schemes

| | | |
|---|---|---|
| $A^* + BC \rightarrow$ | $A + BC^* + e$ | penning ionization |
| $\rightarrow$ | $A + BC^{**} + e$ | penning double ionization |
| $\rightarrow$ | $ABC^* + e$ | associative ionization |
| $\rightarrow$ | $A + B^* + C + e$ | dissociative ionization |
| $\rightarrow$ | $AB^* + C + e$ | rearrangement ionization |
| $\rightarrow$ | $A + B^* + C$ | ion pair formation |
| $\rightarrow$ | $A^* + BC$ | ion pair formation |

Optionally, reaction cell 370' may be suitably pressurized to cool ions exiting cell 314. Inert gases such as $N_2$, Ar or other gases at ambient temperature or below may be used.

In an alternate embodiment, analyte gas may be introduce into inlet 330 of chamber 314 of FIG. 3. Electron bombardment may cause the analyte gas to ionize and/or fragment. Ionized and/or fragmented analyte may exit outlet 332, and further interaction with gas introduced into reaction cell 370' by way of inlet 364'.

In one embodiment, analyte gas may be introduced into inlet 364' and a suitable chemical ionization or other analyte gas may be introduced into chamber 314 by way of inlet 330.

Example reactions for analyte A introduced into chamber 314, and analyte gases $An_1$, $An_2$ introduced into inlet 364' of reaction cell 370' include:

| | Bombarding Gases | | | |
|---|---|---|---|---|
| | Atom | E* (ev) | $t_{rad}$ (s) | $E^1$ (ev) |
| $A + e^- >> A^+$ | He* | 19.82 | 7900 | 24.6 |
| $A^+ + An_1 >> An_1^+$ $IE(An_1) < IE(A)$ | Ne* | 16.61 | 430 | 21.56 |
| $A^+ + An_2 >> An_2^+$ $IE(An_2) > IE(A)$ | Ar* | 11.55 | 45 | 15.76 |
| | Kr* | 9.915 | 85 | 14.00 |
| | Xe* | 8.315 | 150 | 12.13 |
| | $N_2$* | 8.52 | 0.7 | 14.51 |
| | NO* | 4.7 | 0.2 | 9.26 |
| | CO* | 6.0 | 0.02 | 14.01 |

As is known in the art, other reaction pathways could include adduct formation and/or cluster ion formation.

Resulting ionized analyte may be passed downstream along axis 320 for further analysis in downstream stages of mass analyser 300. Mass analyser 300 may for example be a fourier transform ion cyclotron resonance, time of flight, or other mass analyser. Downstream stages may thus include one or more quadrupoles, (e.g. one, two or three) or other mass filters, ion traps, and ultimately an ion detector to detect ions having a mass/charge ratio of interest, that art not specifically illustrated. Other mass analyser stages known to those of ordinary skill may also be included.

Of course, the above described embodiments are intended to be illustrative only and in no way limiting. The described embodiments are susceptible to many modifications of form, arrangement of parts, details and order of operation. The invention is intended to encompass all such modification within its scope, as defined by the claims.

What is claimed is:

1. A mass analyzer comprising:

a chamber having a first gas inlet for receiving gas, and an ion outlet opposite the gas inlet;

an electron source and an accelerator to provide an accelerated electron beam;

said chamber further comprising an electron inlet to receive the accelerated electron beam from the electron source and the accelerator, and an electron collector opposite said electron inlet, and arranged to direct the accelerated electron beam from said electron source and accelerator through said electron inlet, along a path transverse to a path between said first gas inlet and said ion outlet; and a downstream reaction cell that receives ions directly from the chamber, the reaction cell comprising a second gas inlet to receive a second gas to allow said received second gas to interact with ions received from the chamber.

2. The mass analyzer of claim 1, wherein said first gas includes an analyte.

3. The mass analyzer of claim 2, wherein said second gas reacts with ions from said ion outlet to cause fragmentation.

4. The mass analyzer of claim 2, wherein said second gas reacts with ions from said ion outlet to cause adduct formation.

5. The mass analyzer of claim 4, wherein said reaction gas comprises at least one of $NH_3$, $CH_4$, and Cl.

6. The mass analyzer of claim 4, wherein a chemical ionization gas is provided to said chamber coaxially with said gas.

7. An ion source comprising:

a chamber having a gas inlet for receiving gas including an analyte and an ion outlet opposite said gas inlet; and an electron source and an accelerator comprising a conductive helical coil for generating a magnetic field that accelerates electrons from the electron source to provide an accelerated electron beam into the chamber;

said chamber further having electron inlet, and an electron collector opposite said electron inlet, and arranged to direct the accelerated electron beam from said electron source and accelerator through said electron inlet, along a path transverse to a path between said gas inlet and said ion outlet.

8. The ion source of claim 7, wherein said gas is received from a gas chromatograph.

9. The ion source of claim 7, wherein said electron source comprises a lens at said ion outlet for focusing ions from said ion source.

10. The ion source of claim 7, wherein said chamber further comprises a charge plate for accelerating ions in said gas.

11. The ion source of claim 7, wherein said chamber comprises multiple electron inlets, spaced along one side of said chamber.

12. The ion source of claim 7, wherein said chamber comprises a second gas inlet, for providing a second source of gas to said chamber.

13. The ion source of claim 12, wherein said second source of gas is provided coaxially with said gas including said analyte.

14. The ion source of claim 12 or 13, wherein said second source of gas is a reactant gas to react with said analyte.

15. The ion source of claim 12 or 13, wherein said second source of gas is a bombarding gas.

16. An ion source for a mass analyzer comprising:

a first chamber having a first gas inlet for receiving gas, and an ion outlet opposite said gas inlet;

an electron source and an accelerator to provide an accelerated electron beam into the first chamber;

said first chamber further having electron inlet, and an electron collector opposite said electron inlet, and arranged to direct the accelerated electron beam from said electron source and the accelerator through said electron inlet, along a path transverse to a path between said first gas inlet and said ion outlet;

a second chamber comprising a second gas inlet to receive a second gas, said second chamber located downstream of said first chamber for receiving ions directly from said ion outlet, and allowing said second gas to interact therewith.

17. An ion source for a mass analyzer, comprising first and second chambers, wherein the first chamber comprises an electron source and an accelerator to provide a beam of accelerated electrons into the first chamber to allow electron bombardment of a first gas introduced into the first chamber, and wherein the second chamber receives a second gas and ions directly from the first chamber to allow interaction between the second gas and the ions provided from the first chamber.

18. The ion source of claim 17, wherein the first gas includes analyte, for analysis by said mass analyzer.

19. The ion source of claim 17, wherein the second gas includes analyte, for analysis by said mass analyzer.

20. The mass analyzer of claim 1, wherein the accelerator comprises a coil.

* * * * *